United States Patent [19]

Berl et al.

[11] Patent Number: 4,694,844

[45] Date of Patent: Sep. 22, 1987

[54] TOOTHBRUSH

[76] Inventors: Marta N. Berl, 15 Usha Street, Kiryat Bialik; Esther Turner, 4 Harakafot Street, Haifa, both of Israel

[21] Appl. No.: 704,632

[22] Filed: Feb. 22, 1985

[30] Foreign Application Priority Data

Feb. 27, 1984 [IL] Israel ..... 71065

[51] Int. Cl.[4] ..... A46B 3/00

[52] U.S. Cl. ..... 132/84 R; 15/167 R

[58] Field of Search ..... 132/84 R, 83; 15/167 R, 15/167 A, 190, 191, 201

[56] References Cited

U.S. PATENT DOCUMENTS

| | | | |
|---|---|---|---|
| 2,864,111 | 12/1958 | Rotceig | 15/201 |
| 2,882,544 | 4/1959 | Hadidian | 15/167 R |
| 2,935,755 | 5/1960 | Leira et al. | 15/167 R |
| 3,082,457 | 3/1963 | Lucibello et al. | 15/201 |
| 3,129,449 | 4/1964 | Cyzer | 15/167 R |
| 3,739,419 | 6/1973 | Natman et al. | 15/201 |
| 4,240,452 | 12/1980 | Jean | 132/84 R |

*Primary Examiner*—Robert Peshock

*Attorney, Agent, or Firm*—Scully, Scott, Murphy & Presser

[57] ABSTRACT

There is provided a toothbrush comprising a handle and a hollow head supporting a plurality of tufts, each tuft consisting of a bundle of bristles fixedly joined together at one end. The head further comprises an elastically deformable element which, in the state of rest of the toothbrush, urges the tufts towards a limit position. When pressure is applied to at least one tuft during the use of the toothbrush, it causes the collective tips of the tufts to conform to the contours of a given group of teeth as a result of the tufts being pushed into the hollow head to varying degrees against the restoring force of the elastically deformable element.

9 Claims, 10 Drawing Figures

TOOTHBRUSH

The present invention relates to a toothbrush in which the collective tips of the brush tufts are able to change their surface contour in order to match the dental contour to be cleaned and/or massaged.

The centerline of the teeth and gums, and the surface of every tooth are curved. the curvature of, and the distance between, the teeth are a function of location in the mouth and differ from one tooth section to another, as well as from one person to another. Yet conventional toothbrushes ignore this basic fact of dentition. Their tip surfaces are usually either plane or slightly concave, as a result of which their cleaning action will be poor, especially where most needed, i.e., in the spaces between the teeth and the boundary between teeth and gums. If stronger pressure is applied via the handle, this will cause softer bristles to spread, losing their mutual support, and to "wipe" the tooth surface with the sides of the bristles rather than clean them with their tips, thus even reduce their effectiveness. Using harder bristles on the other hand may cause excessive wear to the tooth enamel and may injure the gums.

It is the object of the present invention to overcome the disadvantages and drawbacks of the prior-art toothbrushes and to provide a toothbrush that produces a good cleaning effect regardless of its position relative to the dentition and is capable of dislodging food or other particles from between teeth and the edges of the gums without need for excessive and damaging pressure or the need for overly hard bristles.

This the invention achieves by providing a toothbrush comprising:

a handle:

a hollow head contiguous with said handle and having a bottom provided with a plurality of holes passing through said bottom;

a plurality of tufts, each tuft consisting of a bundle of bristles fixedly joined together at one end portion thereof, said end portions forming joints, at least some of said tufts being slidingly mounted in said holes, with said joints located inside the hollow of said head, and the major portion of each of said tufts projecting from said head;

a cover plate for said head, to cover the hollow side thereof, and at least one elastically deformable element located inside said hollow head, which element, in the state of rest of said toothbrush, urges at least one of said tufts towards a limit position, wherein pressure applied to at least one tuft during use of said toothbrush will cause the collective tips of said tufts to conform to the contours of a given group of teeth as a result of at least one of said tufts being pushed into said head to varying degrees against the restoring force of said elastically deformable element.

The invention further provides other structural solutions for independently moving single tufts or limited groups of such tufts.

The invention will now be described in connection with certain preferred embodiments with reference to the following illustrative figures so that it may be more fully understood.

With reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

IN THE DRAWINGS

Figure 1:
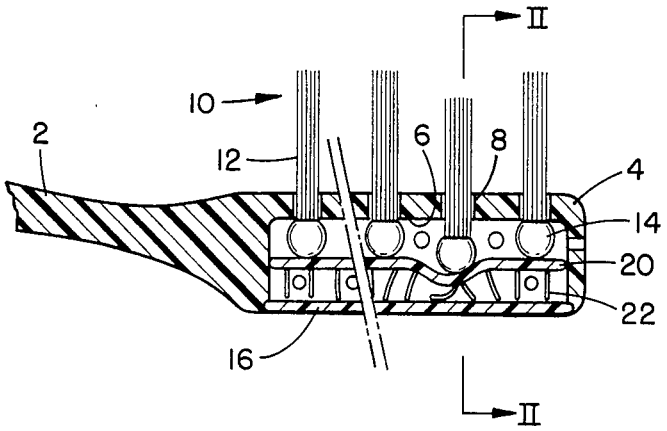
FIG. 1 is a longitudinal cross section, to an enlarged scale, of the toothbrush according to the invention.
Figure 2:
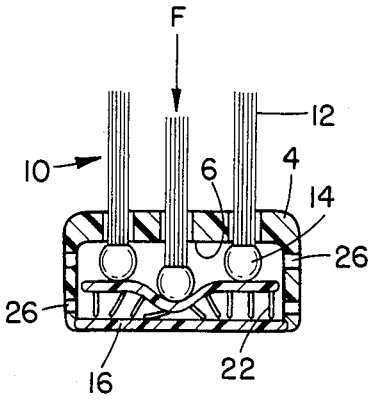
FIG. 2 is a transverse cross section along plane II—II of FIG. 1.
Figure 3:
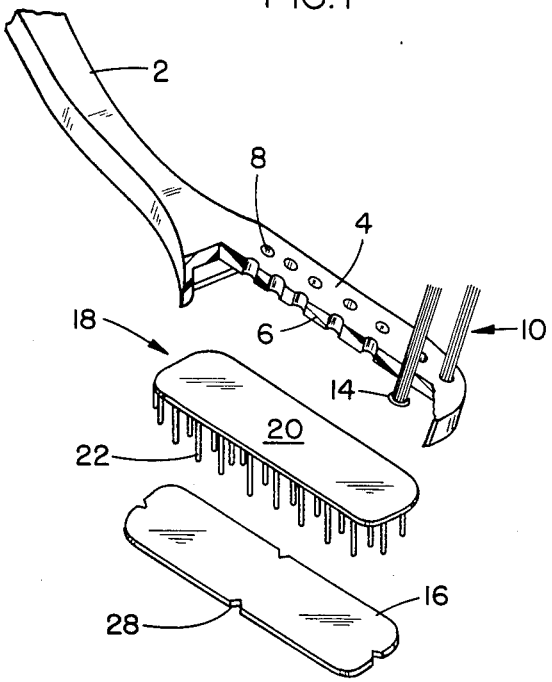
FIG. 3 is an exploded view, partly cross-sectional, of the toothbrush of FIG. 1.

Referring now to the drawings, there is seen in FIGS. 1 to 3 a toothbrush having a handle 2 and a hollow head 4 contiguous with the handle 2. The hollow head 4 has a bottom 6 provided with a plurality of holes 8 which pass through the bottom 6. These holes 8 serve to slidingly accommodate tufts 10 consisting of bundles of bristles 12 fixedly joined together at one of their end portions, which form joints 14 of a thickness or diameter exceeding that of the bundles themselves and will thus not pass through the holes 8. In assembly, as can be seen in the drawings, the joints 14 are located inside the hollow of the head 4, with the major portion of each of the tufts 10 projecting from the head 4.

Figure 6:
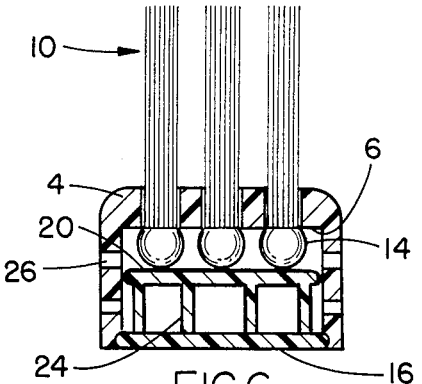
FIG. 6 is a transverse cross section, showing the elastically deformable element of FIG. 5 in position.

The hollow of the head 4 is closed by a cover plate 16 fixedly attachable to the head 4, preferably by means of a snapin arrangement as clearly shown in FIGS. 1, 2 and 6.

Figure 4:
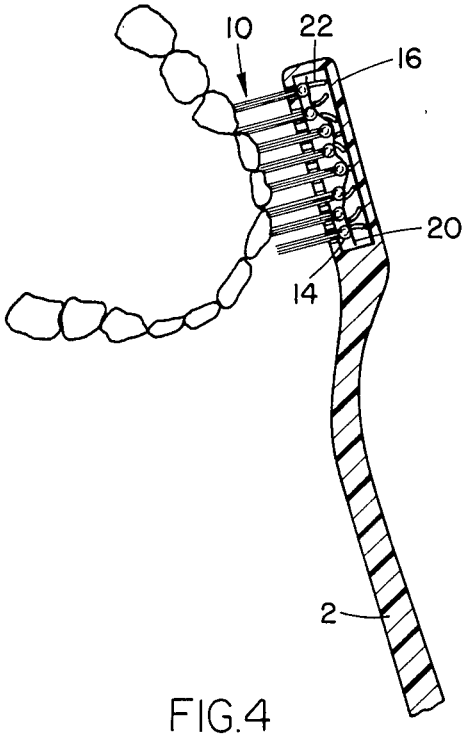
FIG. 4 shows the tooth brush according to the invention as applied against a section of teeth.

Between the joints 14 and the cover plate 16, and touching both, there is mounted inside the hollow head 4 an elastically deformable element 18 which, in the present embodiment, is made of an elastomer such as, e.g., neoprene, and consists of a relatively thin plate 20, from one side of which protrude a plurality of flexible, finger-like projections 22. The plate 20 fills the outline of the hollow with clearance and what is in FIGS. 1–3 its upper surface, is in contact with the joints 14, while the projections 22 rest against the inner surface of the cover plate 16. In the state of rest of the toothbrush the elastically deformable element 18 thus urges the tufts 10 towards a limit position in which the joints 14 abut against the bottom 6 (as is seen in FIG. 1 with three tufts 10 of the four represented), and the tufts 10 project from the head 4 to their maximum height. If now the toothbrush is applied to the teeth, that is, if, via handle 2 and head 4, pressure is applied to those tufts 10 that make contact with the teeth as shown in FIG. 4, these tufts will be pushed into the head 4 to carying degrees, causing the projections 22 nearest to them first to buckle, then, if further pushed, to collapse. the situation is clearly demonstrated in FIGS. 1 and 2, where one tuft 10 is shown thus affected by a reactive force F. Its joint 14 dents the plate 20 and causes some of the projections 22 to buckle. It is these buckled projections 22 as well as the dented plate 20 that provide the force that tends to restore the tufts 10 to their original position and produces the contact pressure of the collective tips of the tufts that now conform to the contours of a particular group of teeth (see FIG. 4).

Figure 5:
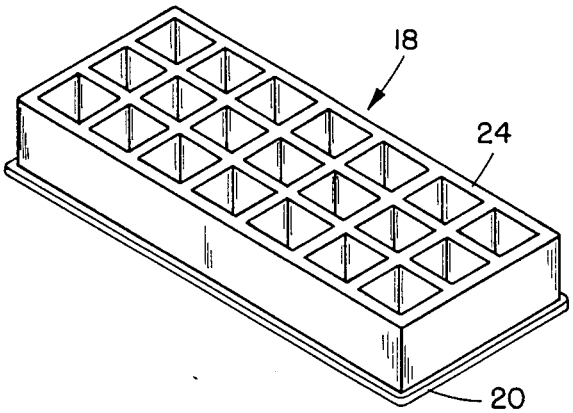
FIG. 5 is a perspective bottom view of another embodiment of the elastically deformable element of the toothbrush.

FIG. 5 is a greatly enlarged perspective bottom view of another embodiment of the elastic element 18, shown in position in FIG. 6. The element 18 is here seen to consist of a plate 20 with which are integral a plurality of thin ribs 24, some of them longitudinal, some transverse, producing a box-like effect. It would also be possible to have only longitudinal, or only transverse, ribs 24, or ribs that, relative to the outline of the plate 20, are slanting. The action of this embodiment of the elastically deformable element 18 is analogous to that of the previous embodiment.

A number of holes 26 provided on some of the walls of the head 4, as well as the notches 28 along the edges of the cover plate 16 permit flushing and draining of the interior of the head 4.

Figure 7:
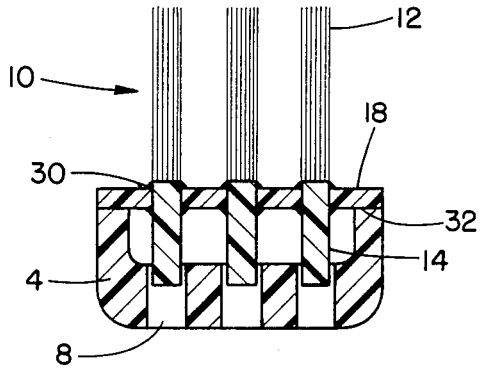
FIG. 7 is a transverse cross section of another embodiment of the toothbrush according to the invention.

In another embodiment of the toothbrush according to the invention, the elastically deformable element 18 serves also for covering the hollow side of the head 4, as can be seen in FIG. 7. The bristles 12 forming the tufts 10 are joined at their end portions, forming joints 14 which slidingly fit the holes 8 in what constitutes the bottom of the hollow head 4. At a higher point, adjacent to the joints 14, the tufts 10 are fixedly cemented to the elastically deformable element 18 at points 30. The element 18 in its turn is cemented to the rim 32 of the hollow head 4. From the drawing it is obvious that pressure exerted on a particular tuft or group of tufts 10 will cause them to be pushed into the head together with the associated section of the deformable element 18, against the restoring force of the latter which tends to maintain them in the position shown in FIG. 7 in which the element 18, being undeformed, assumes a state in which its surface area is minimal.

Figure 8:
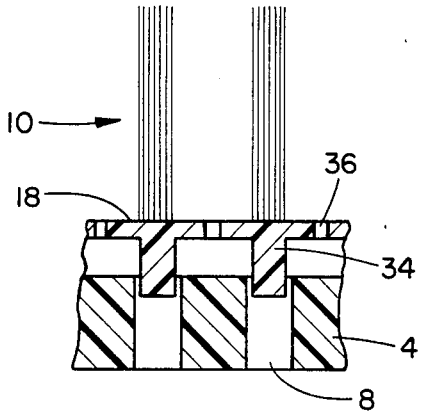
FIG. 8 is a cross-sectional view illustrating yet another embodiment.

In yet a further embodiment (FIG. 8), the tufts 10 are integrally molded together with the elastically deformable element 18, which thus forms their common base. On its other face, the element 18 is provided with a plurality of projections 34, each substantially coaxial with one each of the tufts, and slidingly fitting the holes 8 of the head 4, thus preventing the tufts from tilting over at the slightest lateral pressure. The elastically deformable element 18 is advantageously subdivided into "subelements" by the provision of slots 36, which give each drift greater independence of pressure-induced movement.

Figure 9:
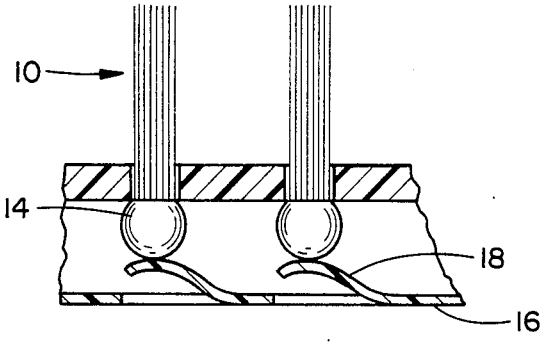
FIG. 9 shows another embodiment of the elastically deformable element.

FIG. 9 shows an embodiment in which the elastically deformable element 18 is an integral part of, being lifted by a stamping operation from, the cover plate 16, each tuft being provided with its own element 18. In this case the cover plate 16 is best made of a corrosion-resistant, springy sheet metal such as stainless steel, although integral plastic designs are also possible.

Figure 10:
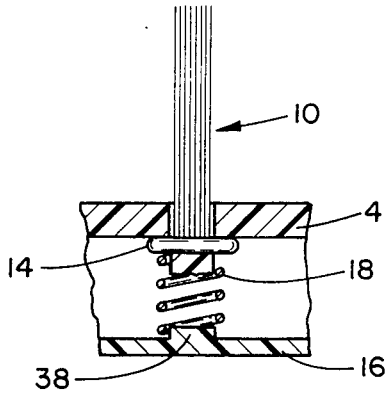
FIG. 10 illustrates yet another embodiment of this element.

Another individual elastically deformable element 18 is shown in FIG. 10 in the form of a helical compression spring seated, on one end, against the collar-like joint 14 of the tuft 10 and, on the other end, against the cover plate 16 which, for location of the spring 18, is provided with a low projection 38.

The tufts 10 can be made from any suitable bristles, even varying in diameter or material. The individual tufts can also be arranged in groups, each group moving together.

While the drawings show the handle 2 to be integral with the head 4, embodiments can also be envisages in which these two components are separate, but connectable to one another.

It will be evident to those skilled in the art that the invention is not limited to the details of the foregoing illustrative embodiments, and that the present invention may be embodied in other specific forms without departing from the essential attributes thereof, and it is therefore desired that the present embodiments be considered in all respects as illustrative and not restrictive, reference being made to the appended claims, rather than to the foregoing description, and all changes which come with the meaning and range of equivalency of the claims are therefore intended to be embraced therein.

What is claimed is:

1. A toothbrush comprising:

a handle;

a hollow head contiguous with said handle and having a bottom provided with a plurality of holes passing through said bottom;

a plurality of tufts, each tuft consisting of a bundle of bristles fixedly joined together at one end portion thereof, said end portions forming joints, at least some of said tufts being slidingly mounted in said holes, with said joints located inside the hollow of said head, and the major portion of each of said tufts projecting from said head;

a cover plate for said head, to cover the hollow thereof, and at least one element, elastically deformable in bending, being located inside said hollow head, said elastically deformable element being made of an elastomer and comprising a relatively thin plate, movably disposed in said hollow, one side of which plate is in contact with said tuft joints, and from the other side of which plate protrudes a plurality of flexible members abutting against the inner surface of said cover plate, which elastically deformable element, in the state of rest of said toothbrush, urges at least one of said tufts towards a limit position, wherein pressure applied to at least one tuft during use of said toothbrush will cause the collective tips of said tufts to conform to the contours of a given group of teeth as a result of at least one of said tufts being pushed into said head to varying degrees against the restoring force of said elastically deformable element, and wherein said holes directly support said tufts slidingly mounted therein.

2. The toothbrush as claimed in claim 1, wherein said elastically deformable element is made of an elastomer and comprises a relatively thin plate movably disposed in said hollow, one side of which plate is in contact with said tuft joints and from the other side of which plate protrudes a plurality of flexible ribs abutting against the inner surface of said cover plate.

3. The toothbrush as claimed in claim 1, further comprising a plurality of holes passing through at least one of the surfaces defining said hollow head in the assembled state thereof, to facilitate the flushing and draining thereof.

4. The toothbrush as claimed in claim 1, wherein said elastically deformable element is an integral part of said cover plate.

5. The toothbrush as claimed in claim 1, wherein said elastically deformable element is provided with a plurality of slots subdividing its surface into a plurality of mutually less dependent subelements.

6. A brush head comprising:

a bottom provided with a plurality of holes passing therethrough;

a plurality of lateral walls delimiting, in conjunction with said bottom, a hollow space;

a plurality of tufts, each tuft consisting of a bundle of bristles fixedly joined together at one end portion thereof, said end portions forming joints, at least some of said tufts being slidingly mounted in said holes, with said joints located inside the hollow of said head, and the major portion of each of said tufts projecting from said head;

a cover plate for said head, to cover the hollow thereof and at least one element, elastically deformable in bending, being located inside said hollow head, said elastically deformable element being made of an elastomer and comprising a relatively thin plate, movably disposed in said hollow, one side of which plate is in contact with said tuft joints, and from the other side of which plate protrudes a plurality of flexible members abutting against the inner surface of said cover plate, which elastically deformable element, in the state of rest of said brush, urges at least one of said tufts towards a limit position, wherein pressure applied to at least one tuft during use of said brush will cause the collective tips of said tufts to conform to the contours of a surface feature against which said brush is applied as a result of at least one of said tufts being pushed into said head to varying degrees against the restoring force of said elastically deformable element, and wherein said holes directly support said tufts slidingly mounted therein.

7. The brush as claimed in claim 6, further comprising means for the connection, to said head, of a handle.

8. The toothbrush as claimed in claim 1, wherein said flexible members comprise flexible, finger-like projections.

9. The toothbrush as claimed in claim 1, wherein said flexible members comprise flexible ribs.

* * * * *

UNITED STATES PATENT AND TRADEMARK OFFICE

CERTIFICATE OF CORRECTION

PATENT NO. : 4,694,844

DATED : September 22, 1987

INVENTOR(S) : Marta N. Berl, et al.

It is certified that error appears in the above-identified patent and that said Letters Patent is hereby corrected as shown below:

Column 3, line 3: "collapse. the situation" should read as --collapse. The situation--

In the Claims: please cancel Claim 2

Column 6, Claim 7, line 18: "as claimed in Claim 6" should read as --as claimed in Claim 1--

Signed and Sealed this

Second Day of August, 1988

*Attest:*

*Attesting Officer*

DONALD J. QUIGG

*Commissioner of Patents and Trademarks*